US011525456B2

(12) United States Patent
Decker et al.

(10) Patent No.: US 11,525,456 B2
(45) Date of Patent: Dec. 13, 2022

(54) COMPACT AXIAL FAN

(71) Applicant: Xcelaero Corporation, San Luis Obispo, CA (US)

(72) Inventors: John Decker, Cypress, TX (US); Ralph Carl, Clifton Park, NY (US); David Gonzales Campos, Atascadero, CA (US)

(73) Assignee: Bascom Hunter Technologies, Inc., Baton Rouge, LA (US)

( * ) Notice: Subject to any disclaimer, the term of this patent is extended or adjusted under 35 U.S.C. 154(b) by 785 days.

(21) Appl. No.: 15/743,067

(22) PCT Filed: Jul. 8, 2016

(86) PCT No.: PCT/US2016/041536
§ 371 (c)(1),
(2) Date: Jan. 9, 2018

(87) PCT Pub. No.: WO2017/008025
PCT Pub. Date: Jan. 12, 2017

(65) Prior Publication Data

US 2018/0209438 A1 Jul. 26, 2018

Related U.S. Application Data

(60) Provisional application No. 62/190,418, filed on Jul. 9, 2015.

(51) Int. Cl.
*F04D 29/32* (2006.01)
*F04D 19/00* (2006.01)
(Continued)

(52) U.S. Cl.
CPC ..... *F04D 29/329* (2013.01); *F04D 19/002* (2013.01); *F04D 25/06* (2013.01); *F04D 25/082* (2013.01)

(58) Field of Classification Search
CPC ..... F04D 29/32; F04D 29/325; F04D 29/329; F04D 19/002; F04D 25/06; F04D 25/0606; F04D 25/0613; F04D 25/082
(Continued)

(56) References Cited

U.S. PATENT DOCUMENTS 3,145,910 A * 8/1964 Jolly ..... F04D 29/626 417/363
3,449,605 A * 6/1969 Wilson ..... B01D 46/12 310/58
(Continued)

FOREIGN PATENT DOCUMENTS

WO WO 2008/146154 A2 12/2008

*Primary Examiner* — Eldon T Brockman
*Assistant Examiner* — Elton K Wong
(74) *Attorney, Agent, or Firm* — Henry C. Query, Jr.

(57) ABSTRACT

An axial fan has an inner-rotor motor which includes a drive end, a non-drive end and a shaft which extends axially from the drive end; and an impeller which includes a cylindrical impeller cup and a number of impeller blades that extend radially from the impeller cup. The impeller cup has an open upstream end and a closed downstream end which is connected to the shaft. In operation, the motor spins the impeller to generate an airflow in a direction from the non-drive end of the motor to the drive end of the motor. The impeller cup is configured to receive the motor therein and surround the drive end of the motor but not the non-drive end of the motor. As a result, the non-drive end of the motor is exposed to the airflow during operation of the fan.

12 Claims, 6 Drawing Sheets

(51) Int. Cl.
*F04D 25/06* (2006.01)
*F04D 25/08* (2006.01)

(58) Field of Classification Search
USPC ..... 417/366, 369, 423.15, 360
See application file for complete search history.

(56) References Cited

U.S. PATENT DOCUMENTS 3,937,192 A 2/1976 Longhouse
4,210,833 A 7/1980 Neveux
5,236,306 A 8/1993 Hozak
5,489,186 A * 2/1996 Yapp ..... F01D 5/141 415/208.3
5,730,583 A * 3/1998 Alizadeh ..... F04D 19/002 416/169 A
5,772,176 A * 6/1998 Keck ..... H02K 5/24 248/638
5,944,497 A 8/1999 Kershaw et al.
7,101,149 B2 9/2006 Huber
8,313,282 B1 11/2012 Jarrah et al.
2003/0194327 A1 10/2003 Bradbury et al.
2005/0046284 A1* 3/2005 Kudo ..... F04D 25/082 310/58
2005/0067500 A1* 3/2005 Hong ..... F04D 25/082 237/34
2006/0147322 A1* 7/2006 Lee ..... F04D 25/082 417/366
2006/0239838 A1* 10/2006 Rahbar ..... F04D 25/0606 417/354
2008/0219844 A1 9/2008 Decker et al.
2008/0226454 A1 9/2008 Decker et al.
2011/0044809 A1 2/2011 Stagg et al.
2014/0064941 A1 3/2014 Parodi et al.
2014/0086728 A1* 3/2014 Engert ..... F04D 29/547 415/119
2015/0071793 A1* 3/2015 Sinadinos ..... F04D 25/08 417/321
2016/0348699 A1* 12/2016 Arai ..... F04D 19/002

* cited by examiner

COMPACT AXIAL FAN

The present application is based on and claims the benefit of U.S. Provisional Patent Application No. 62/190,418 filed on Jul. 9, 2015.

BACKGROUND OF THE INVENTION

The present invention relates generally to axial fans. In particular, the invention relates to an axial fan which includes an inner-rotor motor and a deep-cup rotor which is mounted over the drive end of the motor to thereby substantially reduce the axial length of the fan.

Prior art axial fans typically use specially designed outer-rotor motors to achieve a compact axial length. Two examples of such prior art fans are shown in FIGS. 1 and 2. In these fans the impeller is attached directly to a radially outer portion of the motor which rotates in operation. The motor is attached to a stationary support structure located upstream or downstream of the impeller by detachable struts which mount directly to an outer portion of the motor that remains stationary during operation. This type of motor is produced in a limited range of sizes by specialty fan manufacturers, but it is not mass-produced by the major electric motor suppliers because of its limited use in non-fan applications and because it typically has a lower efficiency than an inner-rotor motor.

For newer compact fan applications, a suitable outer-rotor motor design may not be commercially available. A custom design and development effort requires a significant amount of time and expense which may not be acceptable to today's manufacturers, especially for low to moderate volume applications. Use of a pre-existing, mass produced inner-rotor motor avoids the development time and expense of a custom designed motor and also takes advantage of economies of scale to minimize unit costs.

Fans with inner-rotor motors do exist in the prior art, but they typically are not axially compact. An example of such a fan is depicted in FIGS. 3 and 4. Typically, the motor is supported by a frame or fan housing with struts that attach to the mounting feet of the motor. This fan has a significant axial length which is defined by the combined lengths of the motor, the overhung shaft, the impeller, and an inlet bell-mouth. As one can readily see, this prior art inner-rotor motor fan is not axially compact.

Applicant's own prior art Tornado™ fan, which is depicted in FIGS. 5 and 6, is an axially compact fan which incorporates an overhung impeller that includes two small drain holes which allow for fluid communication between the upstream and downstream sides of the impeller cup. These drain holes are provided to prevent pooling of liquids or condensates inside the impeller cup and are not intended to provide reverse flow cooling for the motor. This fan uses a custom inner-rotor motor which is connected to the fan shroud by support struts that are integral to the motor housing and fan shroud. Consequently, the motor cannot be readily removed and replaced.

A prior art fan design which employs reverse flow cooling for a fan motor is described in applicant's U.S. Pat. No. 7,819,641. In the embodiment shown in FIG. 6 of this patent (which is reproduced in the drawings hereof as FIG. 7), a reverse flow cooling arrangement is provided for the downstream impeller 414 of a counter-rotating fan 410. In this fan embodiment, a pressure difference between the upstream and downstream ends of the impeller 414 induces a portion of the airflow (which is sometimes referred to as a bleed stream and is depicted by the broken-line arrows) to flow upstream through a number of inlet openings 454 in the downstream end of the impeller cup, through the motor 440 and back into the main flowpath F through an annular gap 456 located adjacent the upstream end of the impeller. However, since the impeller 414 is driven by an outer-rotor motor 440, the cooling flow passes through the motor rather than around the outside of the motor. In addition, since no means are provided adjacent the gap 456 to direct the bleed stream back downstream, in some applications the bleed stream may adversely impact the main flow stream in the flowpath F.

SUMMARY OF THE INVENTION

In accordance with the present invention, an axial fan is provided which comprises an inner-rotor motor which includes a drive end, a non-drive end and a shaft which extends axially from the drive end; and an impeller which includes a cylindrical impeller cup and a number of impeller blades that extend radially from the impeller cup. The impeller cup comprises an open upstream end and a closed downstream end which is connected to the shaft. In operation the motor spins the impeller to generate an airflow in a direction from the non-drive end of the motor to the drive end of the motor. The impeller cup is configured to receive the motor therein and surround the drive end of the motor but not the non-drive end of the motor. As a result, the non-drive end of the motor is exposed to the airflow during operation of the fan.

In accordance with one embodiment of the invention, the fan may comprise a support structure; a shroud which surrounds the impeller blades; and a number of struts which connect the drive end of the motor to at least one of the support structure and the shroud. In this manner, the motor is supported from said at least one of the support structure and the shroud by the struts. In this embodiment, each strut may include a first leg which extends generally perpendicularly to a rotational axis of the fan and a second leg which extends generally perpendicularly from the first leg along an outer surface of the motor. In addition, each first leg may comprise a distal end which is connected to said at least one of the support structure and the shroud and the second leg may comprise a distal end which is connected to the drive end of the motor. Also, the struts may be detachably connected to the drive end of the motor and said at least one of the support structure and the shroud.

In accordance with another embodiment of the invention, the fan may include a support structure; a shroud which surrounds the impeller blades; and a number of struts which connect the motor to at least one of the support structure and the shroud. Thus, the motor is supported from said at least one of the support structure and the shroud by the struts. In this embodiment, each strut may include a first leg which extends generally perpendicularly to a rotational axis of the fan and a second leg which extends generally perpendicularly from the first leg along an outer surface of the motor. Also, each first leg may comprise a distal end which is connected to said at least one of the support structure and the shroud and the second leg may comprise a distal end which is connected to the motor. Furthermore, the struts may be detachably connected to the motor and said at least one of the support structure and the shroud.

In accordance with yet another embodiment of the invention, the fan may include means for deflecting the airflow over the upstream end of the impeller cup. Such means may comprise, for example, a hub deflector which is secured to one of the motor or a support frame for the motor. The hub deflector may comprise a conical ring having an upstream end which is secured to said one of the motor or a support frame for the motor and a downstream end which diverges radially outwardly from the upstream end.

In accordance with a further embodiment of the invention, the downstream end of the impeller cup may include a number of through holes which extend axially therethrough. In this embodiment, the impeller cup may be configured such that a pressure difference between the upstream and downstream ends of the impeller will induce a portion of the airflow to flow into the through holes, through an annulus between the motor and the impeller cup, and back into the airflow at a location upstream of the impeller cup to thereby cool the drive end of the motor.

In accordance with yet another embodiment of the invention, the shroud may comprise a total axial length which is approximately the same as an axial length of the motor. The shroud may comprise an inlet bellmouth and an exit diffuser, in which event the total axial length of the shroud is approximately the same as the axial length of the motor.

In another embodiment of the invention, the impeller cup may comprise an axial cup length which is approximately 2.3 times an axial blade length of the impeller blades. Also, the shroud may comprise an exit diffuser, in which event both the impeller blades and the exit diffuser are incorporated within the axial space claim of the motor. In an alternative embodiment, the impeller cup may comprise an axial cup length which is approximately 1.7 times an axial blade length of the impeller blades. In this embodiment, the shroud does not comprise an exit diffuser, and both the impeller blades and the shroud are incorporated within the space claim of the motor.

Thus, it may be seen that the invention is directed to a compact axial fan which incorporates an integrated inner-rotor motor. Features of the invention include an overhung impeller with an axially deep cup that surrounds the drive end of an inner-rotor motor, detachable support struts that mount to the drive end of the motor, a motor non-drive end which is exposed to the main airflow, and an optional stationary hub deflector which is attached to the motor support frame located between the support struts and the impeller. The impeller cup may include through-holes that allow reverse flow cooling to ventilate the cavity between the impeller cup and drive end of the motor. The hub deflector guides both the mainstream flow and the reverse cooling flow into the impeller main passage. The fan shroud may incorporate an inlet bellmouth and an exit diffuser while remaining axially shorter than the axial length of the motor. The resulting fan provides an axially compact design with good thermal characteristics suitable for use with an inner-rotor motor.

These and other objects and advantages of the present invention will be made apparent from the following detailed description with reference to the accompanying drawings. In the drawings, the same reference numbers are used to denote similar components in the various embodiments.

DETAILED DESCRIPTION OF THE INVENTION

Figure 1:
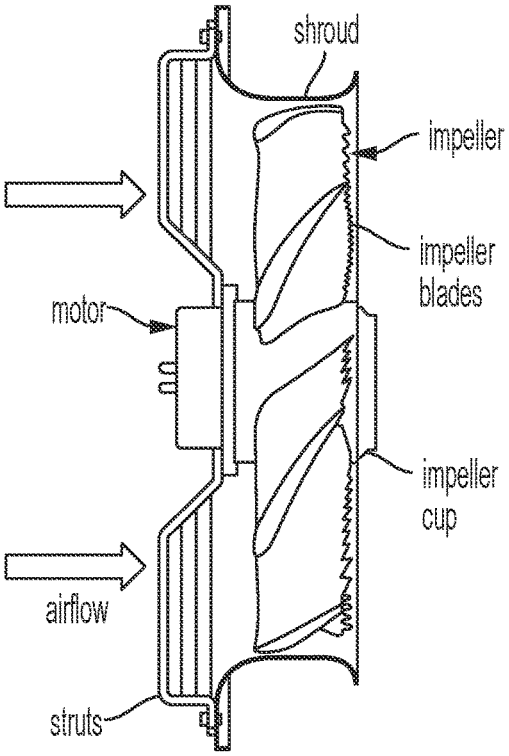
FIG. 1 PRIOR ART
FIG. 1 is a side representation of one example of a prior art outer-rotor motor axial fan.
Figure 2:
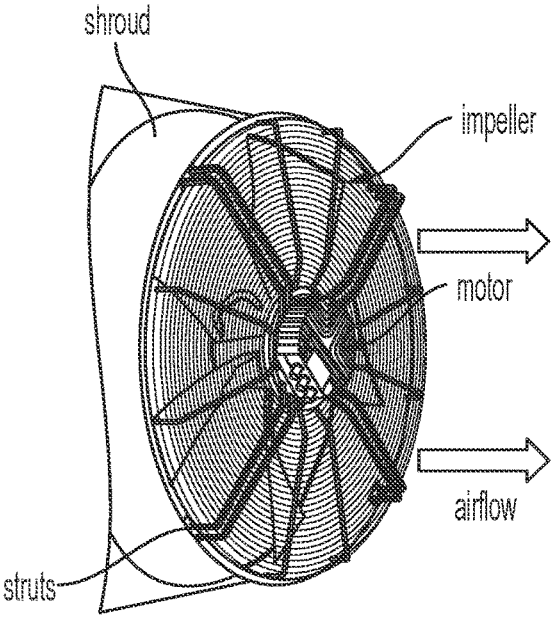
FIG. 2 PRIOR ART
FIG. 2 is a partial front perspective view of another example of a prior art outer-rotor motor axial fan.
Figure 3:
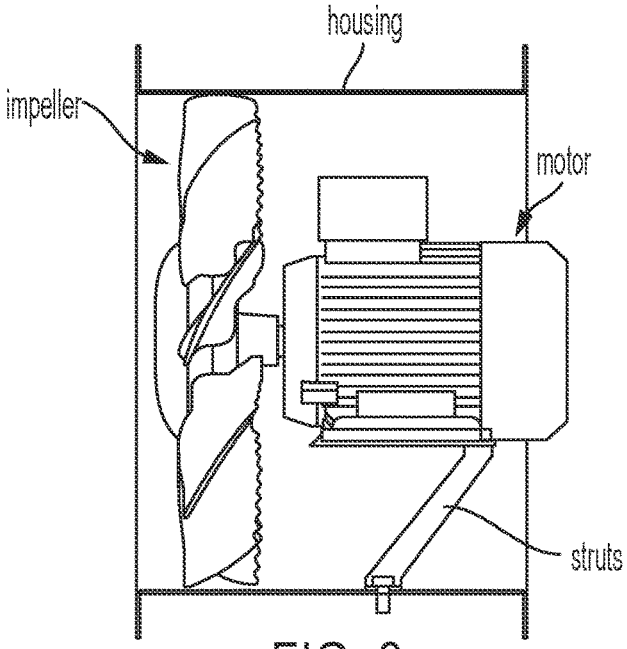
FIG. 3 PRIOR ART
FIG. 3 is a side representation of an example of a prior art inner-rotor motor axial fan.
Figure 4:
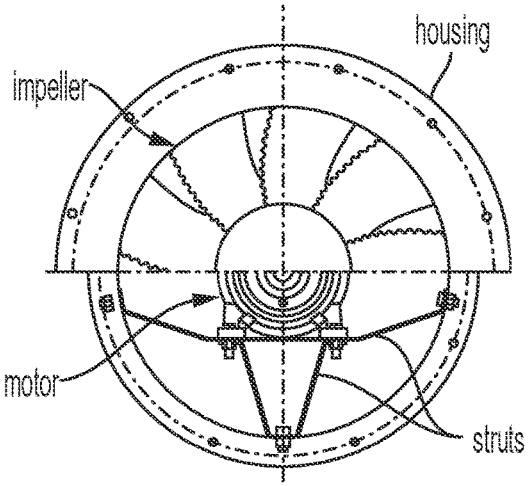
FIG. 4 PRIOR ART
FIG. 4 is a front view of the fan depicted in FIG. 3 but with the lower half of the impeller removed to show the motor support struts.
Figure 5:
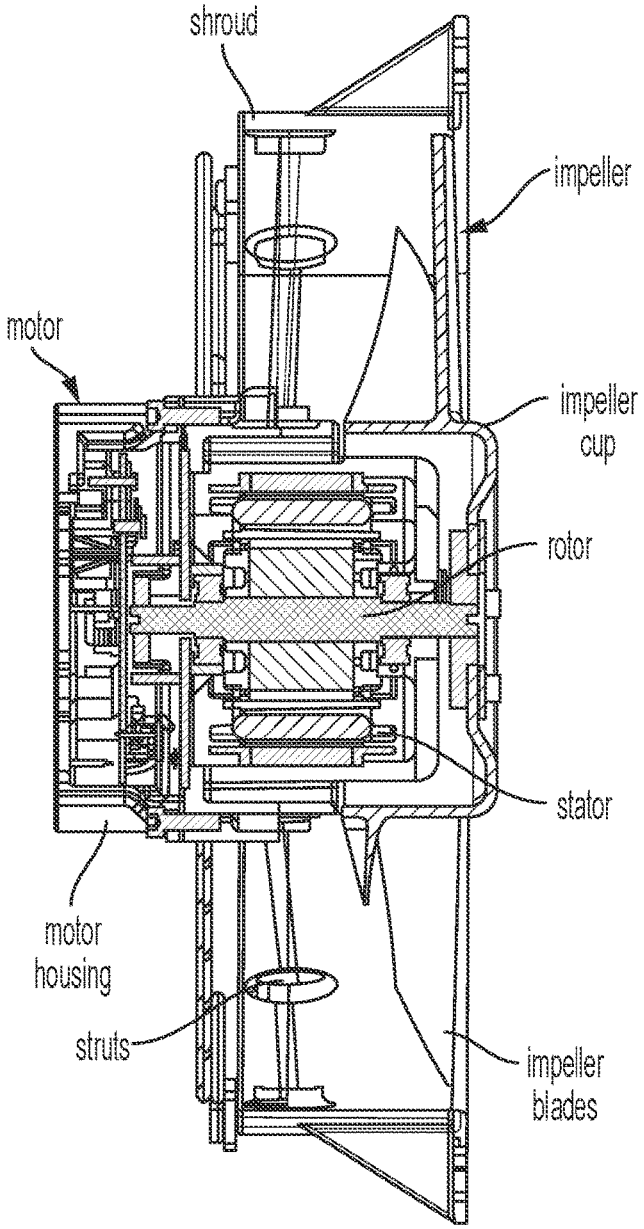
FIG. 5 PRIOR ART
FIG. 5 is a side cross sectional view of another prior art inner-rotor motor axial fan.
Figure 6:
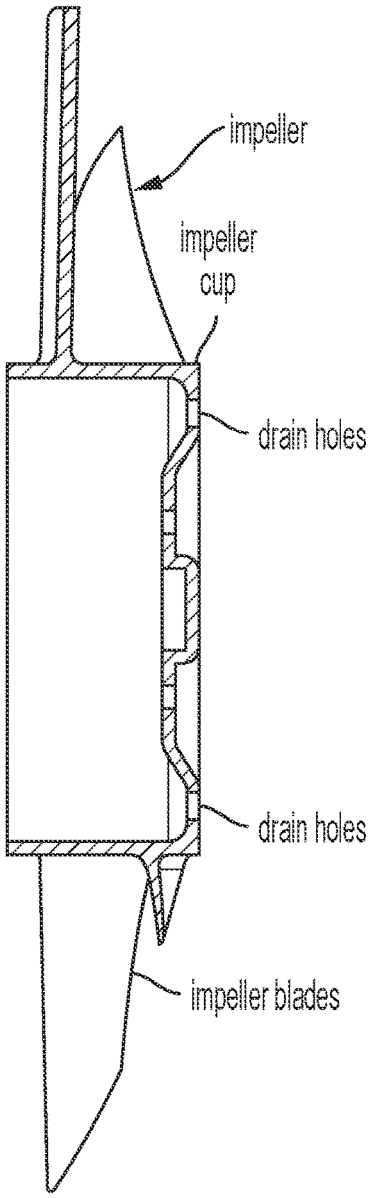
FIG. 6 PRIOR ART
FIG. 6 is a side cross sectional view of the impeller of the fan depicted in FIG. 5.
Figure 7:
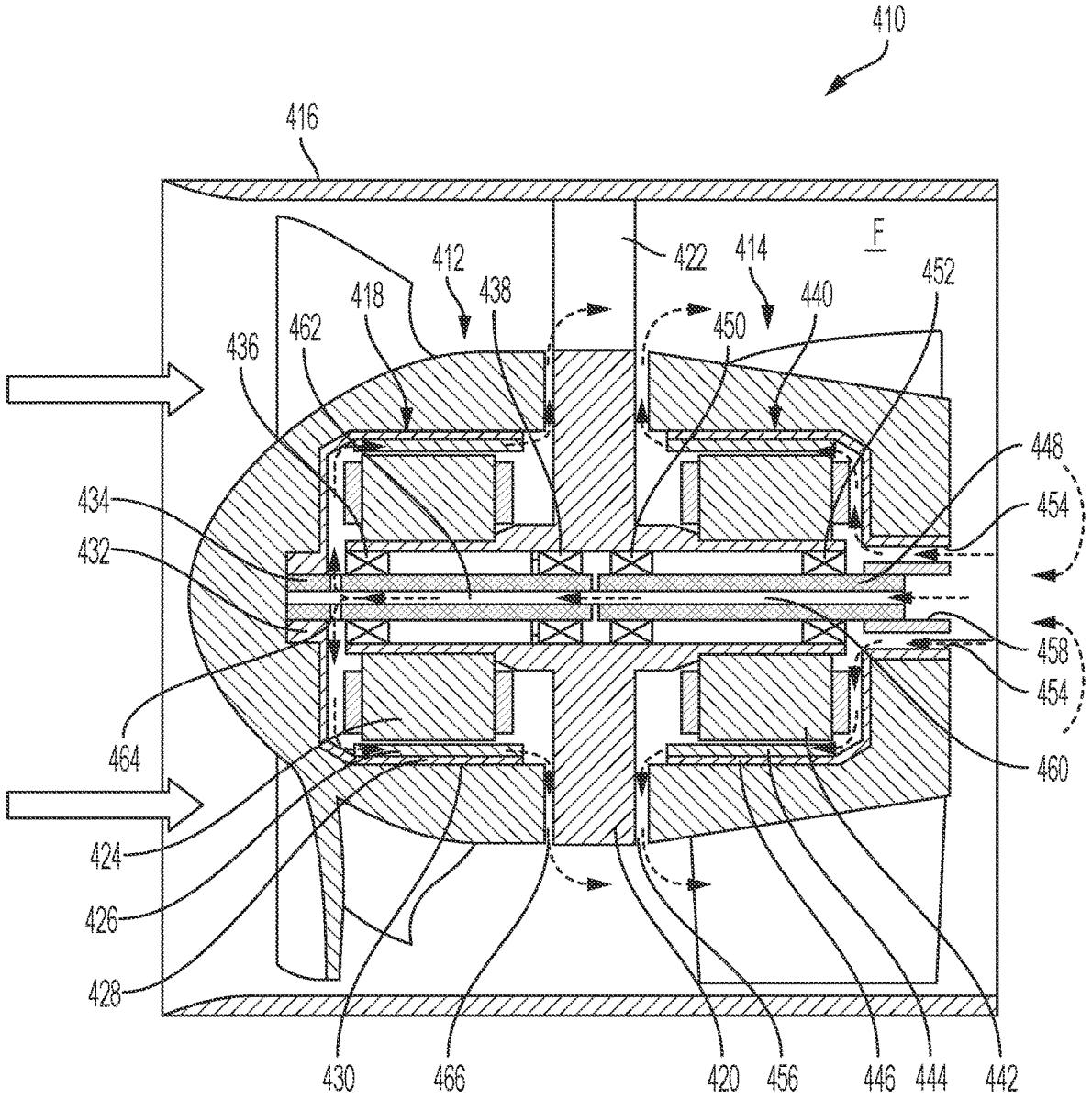
FIG. 7 PRIOR ART
FIG. 7 is a cross sectional view of a prior art counter-rotating axial fan.

The present invention is applicable to a variety of air movers. For purposes of brevity, however, it will be described in the context of an exemplary axial cooling fan. Nevertheless, a person of ordinary skill in the art will readily appreciate how the teachings of the present invention can be applied to other types of air movers. Therefore, the following description should not be construed to limit the scope of the present invention in any manner.

To provide context for the present invention, an exemplary prior art vane-axial cooling fan will first be described with reference to FIG. 8. This prior art cooling fan, which is indicated generally by reference number 10, is shown to comprise a tubular fan housing 12, a motor 14 which is supported in the fan housing, an impeller 16 which is driven by the motor, and an outlet guide vane assembly 18 which extends radially between the motor 14 and the fan housing 12. The fan housing 12 includes a shroud 20 which surrounds the impeller 16, an inlet bellmouth 22 which is formed at the upstream end of the shroud, and an exit diffuser section 24 which is connected to the downstream end of the shroud proximate the outlet guide vane assembly 18.

The motor 14 includes a motor housing 26, a stator 28 which is mounted in the motor housing, a rotor 30 which is positioned within the stator, and a rotor shaft 32 which is connected to the rotor. The rotor shaft 32 is rotatably supported in a front bearing 34 which is mounted in an upstream end of the motor housing 26 and a rear bearing 36 which is mounted in a tail cone 38 that in turn is mounted to the downstream end of the motor housing. The impeller 16 includes an impeller cup 40 and a number of impeller blades 42 which extend radially outwardly from the impeller cup. The impeller cup 40 may also include a removable nose cone 44 to facilitate mounting the impeller 16 to the rotor shaft 32. The outlet guide vane assembly 18 includes an inner ring 46 which is attached to or formed integrally with the motor housing 28, an outer ring 48 which is connected to or formed integrally with the fan housing 12 and a plurality of guide vanes 50 which extend radially between the inner and outer rings. Thus, in addition to its normal function of straightening the air stream generated by the impeller 16, the outlet guide vane assembly 18 serves to connect the motor 14 to the fan housing 12.

Figure 8:
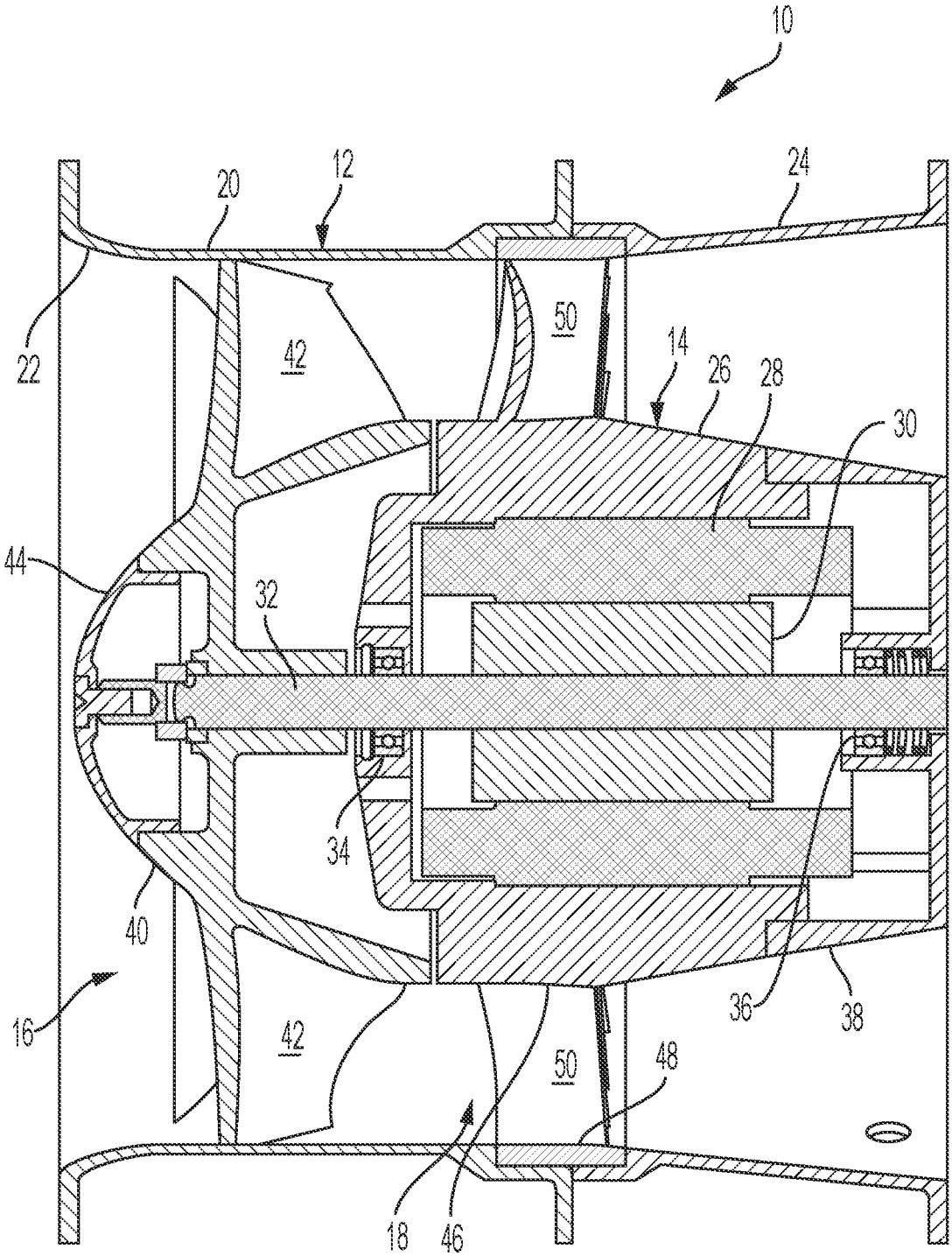
FIG. 8 PRIOR ART
FIG. 8 is a cross sectional view of an example of a prior art inner-rotor motor vane axial cooling fan.

As may be seen from FIG. 8, since the impeller 16 mounts to the upstream end of the motor 14 and the diffuser section 24 extends past the downstream end of the motor, the total axial length of the fan 10 is determined by the combined lengths of the inlet bellmouth 22, the impeller, the motor and the exit diffuser section and/or tail cone 38. In certain applications which afford limited space for the cooling fan, the fan depicted in FIG. 8 may not be appropriate due to its total axial length.

Figure 9:
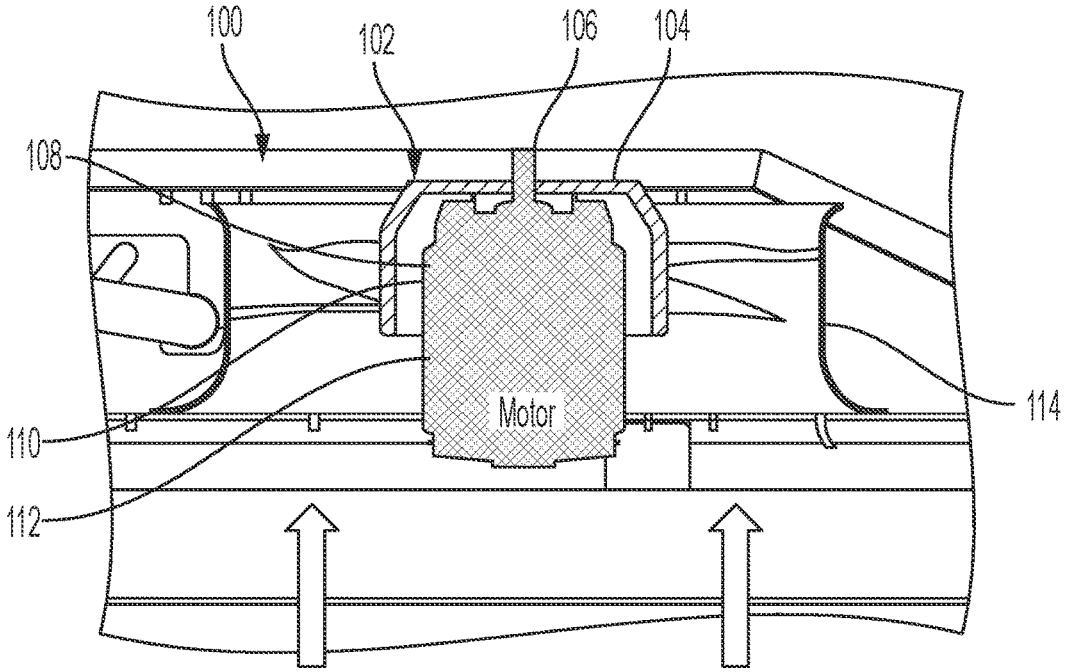
FIG. 9 is a conceptual, cross sectional depiction of an embodiment of an inner-rotor motor axial fan of the present invention with several elements of the fan removed for clarity.

In accordance with the present invention, the total axial length of an axial fan is reduced by providing the fan with an inner-rotor motor and an overhung impeller having an axially deep cup that surrounds the drive end of the motor. Such a fan is shown conceptually in FIG. 9. The fan of this embodiment, which is indicated generally by reference number 100, includes an impeller 102 having an axially deep cup 104 which is mounted to the shaft 106 of an inner-rotor motor 108. The impeller cup 104 is configured to surround the drive end 110 of the motor 108, leaving only the non-drive end 112 of the motor exposed to the airflow (which is depicted by the two wide arrows). The fan 100 includes a shroud 114 which functions to define a path for the airflow and to provide support for the motor 108; however, in FIG. 9 the structure for mounting the motor 108 to the shroud has been omitted for clarity. Thus it may be seen that the total axial length of the fan 100 is basically equal to the length of the motor 108. By selecting an appropriate motor, therefore, the fan 100 may be used in applications affording only limited space for this portion of the cooling arrangement.

Figure 10:
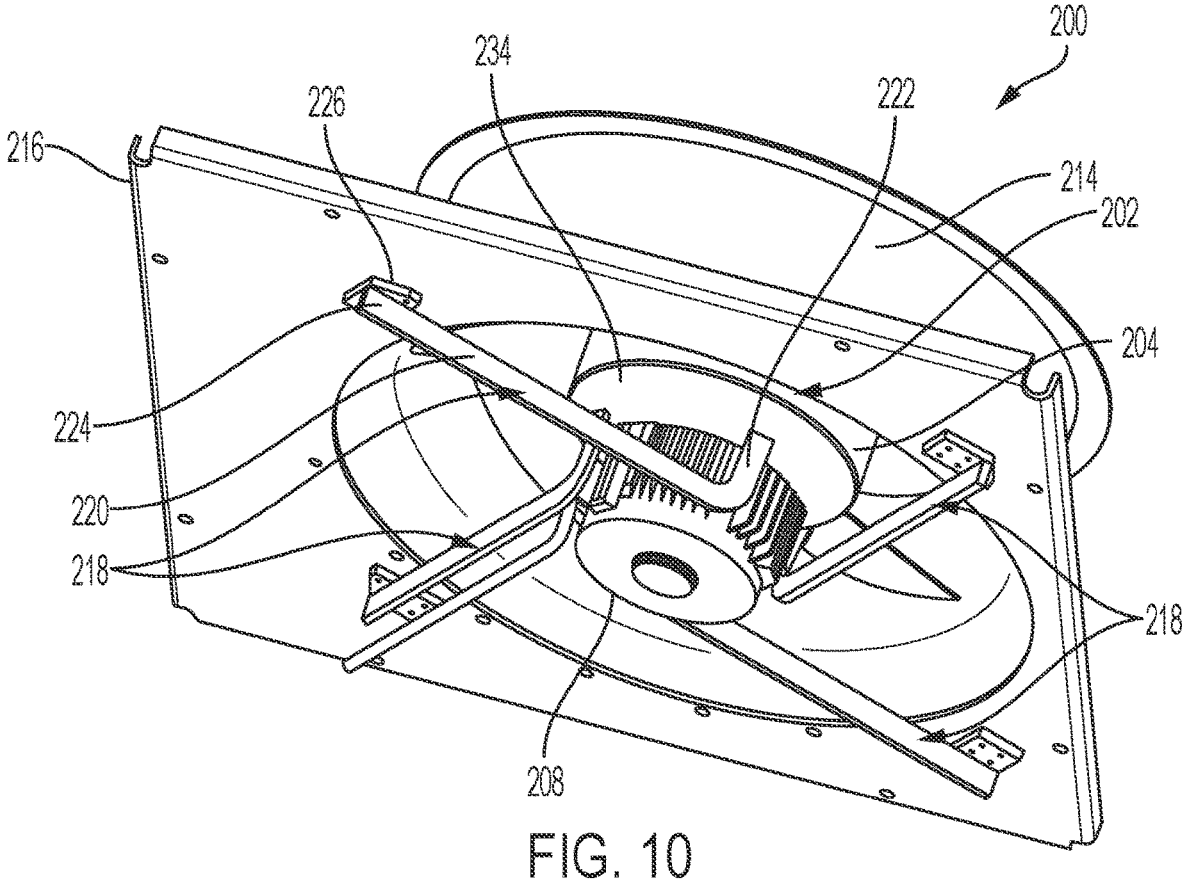
FIG. 10 is a perspective view of another embodiment of an inner-rotor motor axial fan of the present invention.
Figure 11:
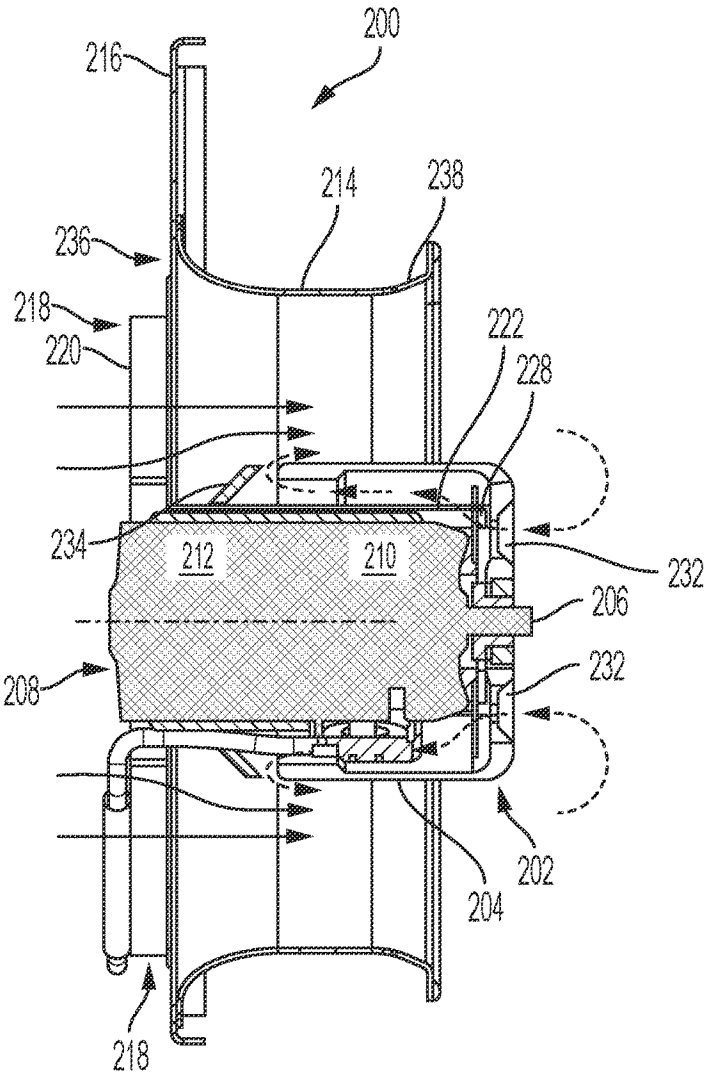
FIG. 11 is a cross sectional representation of the inner-rotor motor axial fan shown in FIG. 10 but with the impeller blades removed for clarity.

Another embodiment of a compact axial fan in accordance with the present invention is shown in FIGS. 10 and 11. Similar to the fan 100 described above, the fan of this embodiment, which is indicated generally by reference number 200, includes an impeller 202 having an axially deep cup 204 which is connected by conventional means to the shaft 206 of an inner-rotor motor 208. The impeller cup 204 is configured to surround the drive end 210 of the motor 208, leaving only the non-drive end 212 of the motor exposed to the airflow. In the present embodiment, the fan 200 includes a shroud 214 which may be connected to a support structure for the fan, such as a support plate 216.

The motor 208 may be connected to the shroud 214 and/or the support plate 216 by a number of preferably detachable struts 218. As shown in FIGS. 10 and 11, e.g., each strut 218 includes a first leg 220 which extends generally perpendicularly to the axis of the fan and a second leg 222 which extends generally perpendicularly from the first leg along the outer surface of the motor 208. In the exemplary embodiment of the invention shown in FIGS. 10 and 11, each first leg 220 has a distal end 224 which is connected to or formed integrally with a mounting pad 226 that in turn is attached to the support plate 216. In addition, each second leg 222 has a distal end 228 which is connected to the drive end of the motor 208. In this manner, the struts 218 are attached to the drive end of the motor 208 to thereby provide secure and stable support for the motor within the shroud 214. In addition, since the struts 218 are releasably fastened to both the support plate 216 and the motor 208, removal and replacement of the motor is quick and simple.

In accordance with another aspect of the invention, the downstream end of the impeller cup 204 may include a number of through holes 232 to facilitate reverse flow cooling of the drive end 210 of the motor 208. In particular, a pressure difference between the upstream and downstream ends of the impeller 202 will induce a portion of the airflow (depicted in FIG. 11 by broken-line arrows) to flow into the through holes 232, through the annulus between the outer surface of the motor 208 and the inner surface of the impeller cup 204, and back into the main airflow at a location upstream of the impeller cup 204. In this manner, the reverse flow will cool the drive end 210 of the motor 208 and lead to improved fan reliability.

In accordance with yet another aspect of the invention, the fan 200 may include means for deflecting the main airflow around the upstream end of the impeller cup 204. Such means may comprise, for example, a hub deflector 234 which is attached to a motor support frame located between the support struts and the impeller. In the exemplary embodiment of the invention shown in FIGS. 10 and 11, the hub deflector 234 comprises a conical ring having an upstream end which is secured to the motor support frame and a downstream end which diverges radially outwardly from the upstream end. As shown in FIG. 11, the hub deflector 234 deflects the main airflow (depicted in FIG. 11 by solid-line arrows) over the upstream edge of the impeller cup 204. In this manner, the hub deflector 234 creates a smooth flowpath transition for the main airflow between the motor 208 and the impeller cup 204. As shown by the broken-line arrows in FIG. 11, the hub deflector 234 also guides the reverse cooling flow back into the main airflow.

As shown in FIG. 11, another feature of the present invention is that the shroud 214 may incorporate an inlet bellmouth 236 and an exit diffuser 238 within the axial space claim of the motor 208. The resulting fan is an axially compact design with good thermal characteristics suitable for use with an inner-rotor motor.

Figure 12:
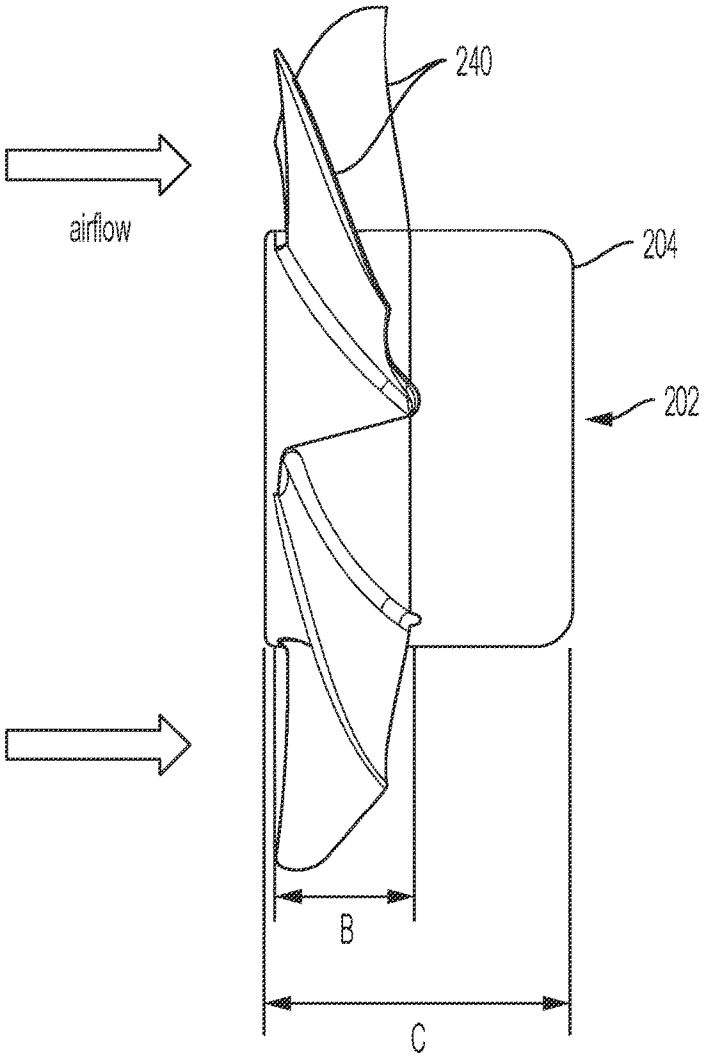
FIG. 12 is a side elevation view of the impeller of the axial fan shown in FIG. 11.

Referring also to FIG. 12, the inventors have found that when the cup length C (i.e., the axial length of the impeller cup 204) is approximately 2.3 times the blade length B (i.e., the axial length of the impeller blades 240), both the impeller blades and the exit diffuser 238 may be incorporated within the axial space claim of the motor 208. While the exit diffuser 238 improves fan efficiency, in an alternative embodiment of the invention the exit diffuser can be eliminated while still maintaining the same axial length of the shroud 214. In this case, the cup length C may be reduced to approximately 1.7 times the blade length B.

It should be recognized that, while the present invention has been described in relation to the preferred embodiments thereof, those skilled in the art may develop a wide variation of structural and operational details without departing from the principles of the invention. For example various features of the different embodiments may be combined in a manner not described herein. Therefore, the appended claims are to be construed to cover all equivalents falling within the true scope and spirit of the invention.

What is claimed is:

1. An axial fan which comprises:

a tubular shroud which includes an upstream end, a downstream end, an inlet bellmouth which extends from the upstream end toward the downstream end, and an exit diffuser which extends from the downstream end toward the upstream end;

an inner-rotor motor which is positioned coaxially within the shroud, the motor including a drive end, a non-drive end and a shaft which extends axially from the drive end, the motor being supported by a number of struts which are connected to the drive end, and the motor being oriented within the shroud such that the drive end is positioned proximate the downstream end of the shroud and the non-drive end is positioned proximate the upstream end of the shroud; and an impeller which includes a cylindrical impeller cup and a number of impeller blades that extend radially from the impeller cup, the impeller cup comprising an open upstream end and a closed downstream end which is connected to the shaft;

wherein in operation the motor spins the impeller to generate an airflow in a direction from the non-drive end of the motor to the drive end of the motor; and wherein the impeller cup is configured to receive the motor therein and surround the drive end of the motor but not the non-drive end of the motor;

whereby the non-drive end of the motor is exposed to the airflow during operation of the fan;

wherein the impeller blades extend axially from proximate the upstream end of the impeller cup toward the downstream end of the impeller cup;

wherein a downstream end of the motor, excluding the shaft, is located proximate the downstream end of the shroud; and wherein the impeller cup and the shroud are configured such that the impeller blades are positioned axially between the inlet bellmouth and the exit diffuser.

2. The fan of claim 1, further comprising:

a support structure;

wherein the struts are connected between the drive end of the motor and at least one of the support structure and the shroud;

whereby the motor is supported from said at least one of the support structure and the shroud by the struts.

3. The fan of claim 2, wherein each strut includes a first leg which extends generally perpendicularly to a rotational axis of the fan and a second leg which extends generally perpendicularly from the first leg along an outer surface of the motor.

4. The fan of claim 3, wherein each first leg comprises a distal end which is connected to said at least one of the support structure and the shroud and the second leg comprises a distal end which is connected to the drive end of the motor.

5. The fan of claim 2, wherein the struts are detachably connected to the drive end of the motor and said at least one of the support structure and the shroud.

6. The fan of claim 1, further comprising means for deflecting the airflow over the upstream end of the impeller cup.

7. The fan of claim 6, wherein the airflow deflecting means comprises a hub deflector which is secured to one of the motor or a support frame for the motor, the hub deflector comprising an annular ring which is positioned around the motor upstream of the impeller cup.

8. The fan of claim 7, wherein the hub deflector comprises a conical ring having an upstream end which encircles the motor and a downstream end which diverges radially outwardly from the upstream end.

9. The fan of claim 1, wherein the downstream end of the impeller cup includes a number of through holes which extend axially therethrough.

10. The fan of claim 9, wherein the impeller cup is configured such that a pressure difference between an upstream end of the impeller and a downstream end of the impeller will induce a portion of the airflow to flow into the through holes, through an annulus between the motor and the impeller cup, and back into the airflow at a location upstream of the impeller cup to thereby cool the drive end of the motor.

11. The fan of claim 1, wherein the shroud comprises a total axial length which is less than an axial length of the motor excluding the shaft.

12. The fan of claim 11, wherein an upstream end of the motor is located upstream of the upstream end of the shroud and the downstream end of the motor, excluding the shaft, is located downstream of the downstream end of the shroud.

* * * * *